US005197936A

United States Patent [19]

Fainberg

[11] Patent Number: 5,197,936

[45] Date of Patent: Mar. 30, 1993

[54] PAIL BOX MACHINE

[76] Inventor: Abram Fainberg, 7 Roger Williams Green, Providence, R.I. 02904

[21] Appl. No.: 793,124

[22] Filed: Nov. 18, 1991

Related U.S. Application Data

[63] Continuation-in-part of Ser. No. 697,254, May 8, 1991, Pat. No. 5,123,888.

[51] Int. Cl.[5] ..... B31B 3/44; B31B 3/86

[52] U.S. Cl. ..... 493/88; 493/167; 493/909

[58] Field of Search ..... 493/1, 2, 30, 88, 167, 493/174, 909

[56] References Cited

U.S. PATENT DOCUMENTS

| | | | |
|---|---|---|---|
| 1,001,198 | 8/1911 | Haas | 493/88 |
| 1,038,145 | 9/1912 | Inman | 493/88 |
| 1,509,191 | 9/1924 | Craig | 493/88 |
| 1,509,192 | 9/1924 | Craig | 493/88 |
| 1,511,320 | 10/1924 | Craig | 493/88 |
| 2,198,740 | 4/1940 | Redman | 493/88 |
| 2,869,438 | 1/1959 | Watson | 493/88 |

*Primary Examiner*—William E. Terrell

[57] ABSTRACT

An automatic pail box machine is disclosed which makes folded boxes from pre-made blanks of paper and attached handles from a flexible strip of blank handles retained in a removable spool. The machine includes a conveyor and clinching mechanisms for utilizing both a flexible strip a strip of straight blank handles and with blank handles the ends of which are pre-bent. Feeding blank handles into position for fastening may be provided by a feeder having electrical solenoids which are energized in timed relationship. A simple anti-retraction device is provided to insure that the flexible strip does not retract.

2 Claims, 4 Drawing Sheets

PAIL BOX MACHINE

CROSS REFERENCE TO RELATED APPLICATION

This application is a continuation-in-part application of U.S. application Ser. No. 07/697,254 filed May 8, 1991, now U.S. Pat. No. 5,123,888.

BACKGROUND OF THE INVENTION

1. Field of the invention

This invention relates to machinery for making paper board containers and, more particularly, to machines for making boxes with handles, preferably from wire.

2. Description of the Prior Art

A well known semi-automatic machine made by Saranac Co. produces boxes with handles made from a coil of wire. In this machine prepared blanks are automatically fed by conveyor. The machine then folds, forms, attaches wire handle from a wire coil, ejects, nests and counts the boxes. Finished boxes are delivered in packages of needed quantity to users. This method of producing boxes by machines of the Saranac type has a number of imperfections which have kept the pail box from wider use:

a. Pail boxes are more expensive relative to the types of boxes with the same purpose;

b. There are problems in automatically separating boxes one from another;

c. Boxes are subject to damage during transportation and d. Present machinery, designed for production of pail boxes in a factory, can't to be installed in an automatic production line for goods;

e. There are problems with advertising the users name and packing the box with goods.

In application Ser. No. 07/697,254 filed May 8, 1991 I presented a hand-operated and automatic machine for producing pail boxes from pre-made blanks of paper and pre-made wire handles bonded together in the form of a bar. Relative to the hand-operated machine with its small capacity, the pre-made handle bar allows succesfully using the machine directly in restaurants, stores, small production companies, etc. But in the case of the automatic machine for continuously producing boxes the machine must be equipped with a mechanism for automatically feeding the handle bars. The other question is a packing problem because the fully made handles require more space for storage. These disadvantages are overcome by the present invention in the matter of providing blank handles which are accomplished in a manner of a fully straight or with two bent ends. The handles are joined together by readily severable adhesive tapes to form a flexible strip which is realed onto a spool for providing a long-term of continuous machine operation without stoping for feeding handles.

SUMMARY OF THE INVENTION

In accordance with the present invention the automatic machine for producing pail boxes is equipped with mechanisms for attaching to the folded box a handle of wire from a flexible strip of blank handles. The blank handles are of two types: type "A" is completely straight and type "B" has bent ends. If the handles are with bent ends the clinching mechanisms only bends the legs of the leader handle and attaches it to the folded box. In the other case when the blank handles of the flexible strip are straight the clinching mechanisms bends the legs of the leader handle (its ends are bent in the previous cycle), attaches it to the folded box, and in the same cycle bends the ends of the next handle. Feeding blank handles into position for fastening is done by a feed mechanism having electrical actuator means which are energized in timed relationship.

DESCRIPTION OF THE PREFERRED EMBODIMENT

Figure 1:
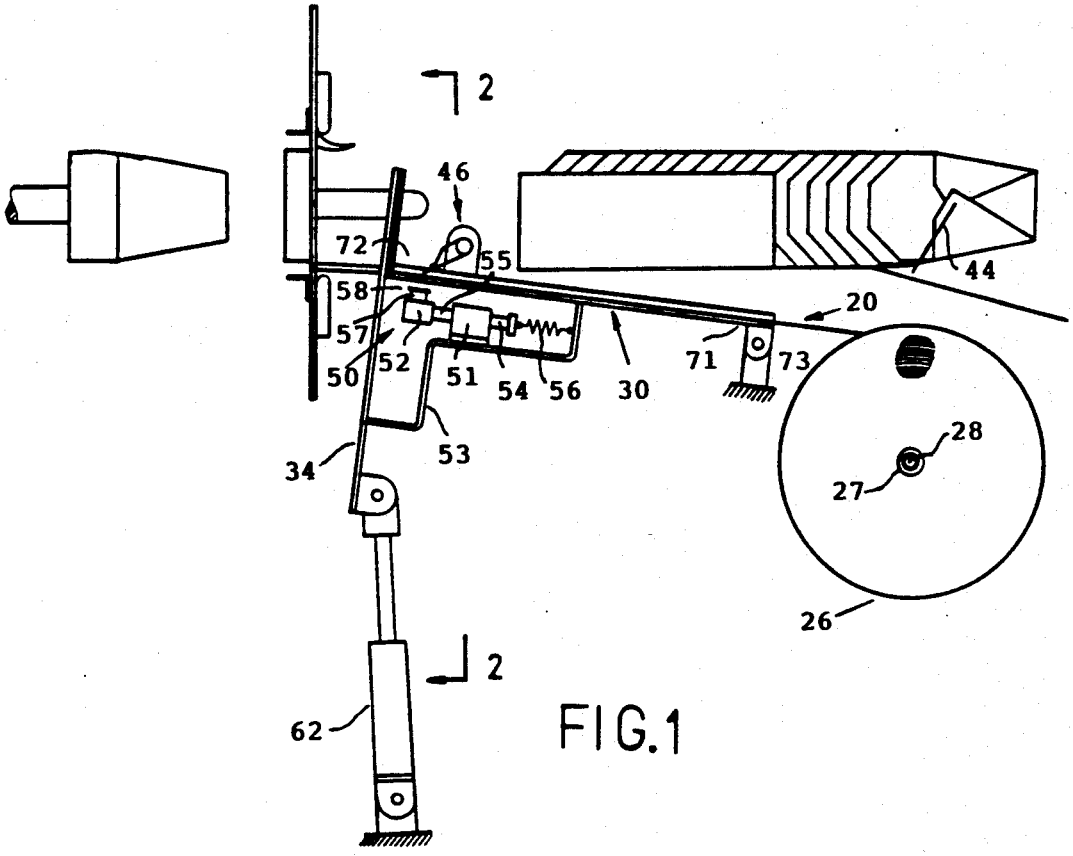
FIG. 1 is side elevation view with portions broken away showing an automatic pail box machine in accordance with the present invention.

The automatic pail box machine is intended for use in an automatic production line for packing with goods or for producing boxes for storage. The machine is intended to produce boxes from pre-made blanks of paper and pre-made blank handles. The machine includes folding means, blank storage assembly, means for intermitently feeding blanks to position for folding, receiver means for receiving made boxes to be packed with goods or for arranging boxes in batches of desired quantity for storage, and drive machine means. All of these mechanisms are approximately simmilar to mechanisms of the automatic machine disclosed in U.S. application Ser. No. 07/697,254 filed May 8, 1991 and are not discribed in detail in this specification.

The mechanisms and elements of the machine to which the improvements are directed includes (see FIGS. 1 and 2): a pin means 28 for accepting a spool 26 or magazine with a flexible strip 20 of blank handles, a conveyor means 30 for conveying the outlet end of the flexible strip, a pair of clinching mechanisms 40 for fastening handles to the folded boxes, a feed means 50 for feeding blank handles to the folded boxes, and an anti-retraction means 46 for insures that the flexible strip 20 does not retract.

Figure 6:
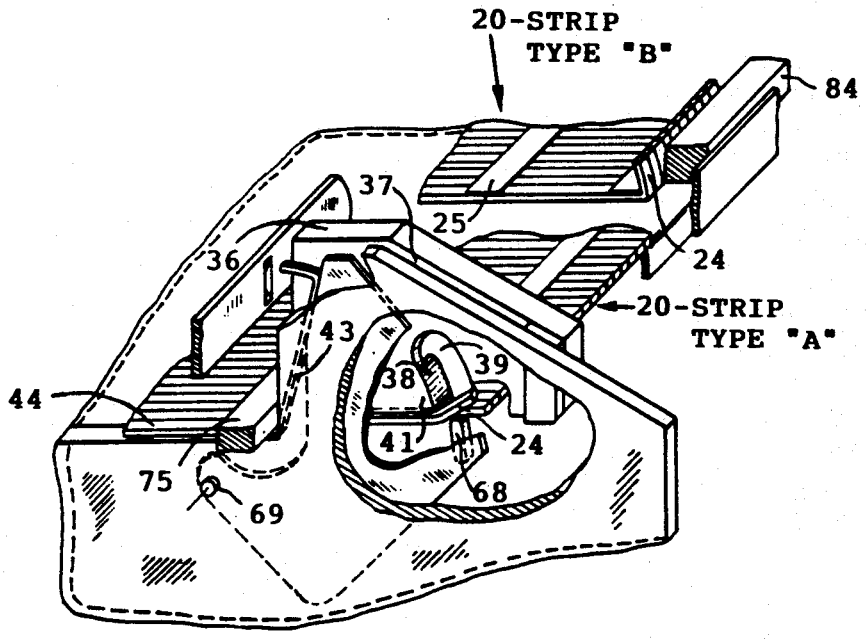
FIG. 6 is a fragmentary perspective view of the conveyor in opposite direction of FIG. 5.
Figure 7:
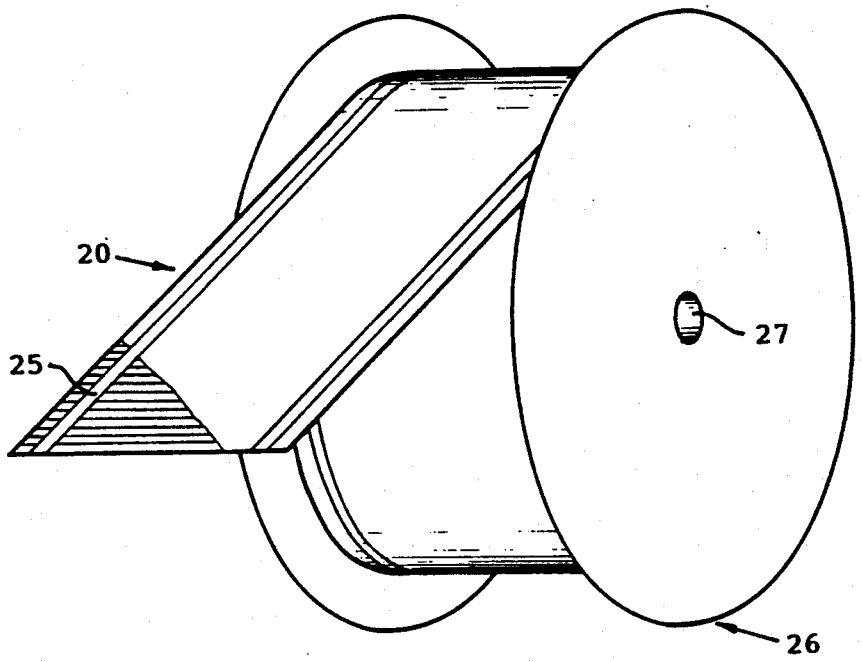
FIG. 7 is a perspective view of the flexible strip of handles type "A", reeled onto the spool.
Figure 8:
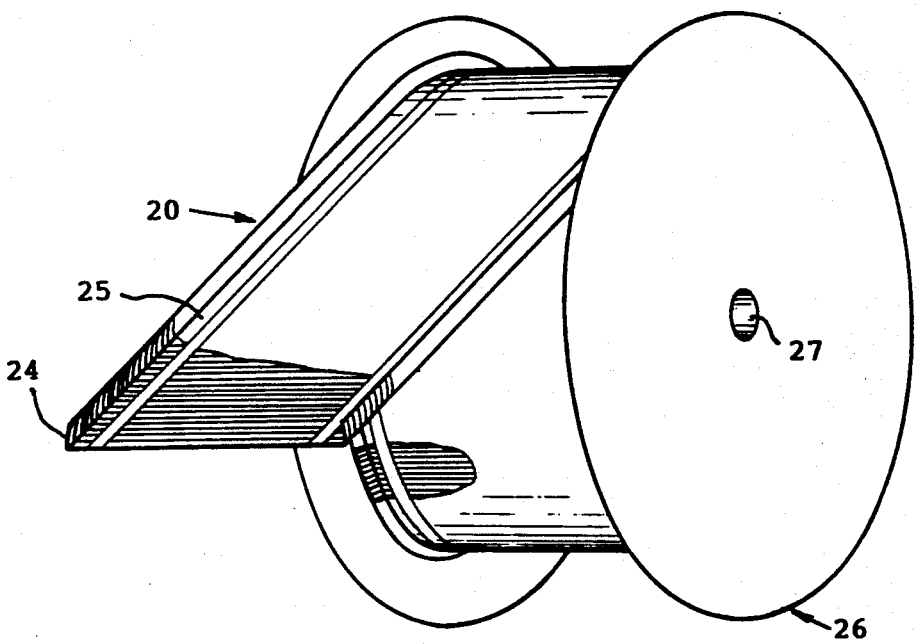
FIG. 8 is a perspective view of the flexible strip of handles type "B", reeled onto the spool.

As shown in FIGS. 6–8 the flexible strip 20 includes blank handles which are preferable straight (type "A") or handles with pre-bent ends 24 (type "B"). The blank handles are joined together by means of readily severable adhesive tapes 25. The flexible strip 20 is reeled onto a removable spool 26 to provide a long-term continuous machine operation. The spool 26 has a consentricly located hole 27 for rotatable mounting on a pin 28 of the machine and during of the process machine work the spool is unreeled.

The base of the conveyor 30 is a plane member 32 with edges 33. To the forward end 72 of the conveyor 30 is a rigidly attached plate 34 (FIGS. 1–6) on which are mounted two clinching mechanisms 40. On the top portion of the plate 34 are two simmetrically secured guide members 36 each of which forms with plate 34 gauged slot 37 for sliding through just one leg 43 of the handle 44. Each guide member 36 has through slot 38 (FIGS. 2 and 6) for passing blank handles of the flexible strip type "B" (FIG. 8) with pre-bent ends 24 and a hollow 39 made on its inside surface for bending ends 24 around anvil 41 in case of using straight blank handles type "A" (FIG. 6). The depth of the hollow 39 is equal to the breadth of the handle for bending both ends strictly on the same plane.

To the upper surface of the conveyor 30 is mounted anti-retraction means 46 having a plurality pawls 47 and springs 48. By this spring 48 the pawl 47 is adapted to abut the flexible strip 20 to prevent it from retrograde movement.

The rear end 71 of the conveyor 30 is mounted pivotally to allow the forward end 72 together with plate 34, clinching mechanisms 40 and other details attached to the conveyor to be raised and lowered about horizontal axis 73. In raising position of the conveyor 30 the flexible strip 20 touched the rest 75 which is secured to the frame of the machine and about which the legs 43 of the handles are bent. From below to the rest 75 (FIG. 4) are mounted latch mechanisms 80 each of which having a pawl 81 and a spring 82 which holds the pawl 81 in a cocked position. Between the rest 75 and the upper portion of the pawls 81 there is a space 83. When the conveyor 30 is moved up (shown by arrow 78) the leader blank handle 44*a* pushes the pawls 81, then passes them to allow the pawls 81 to be cocked out again. After the leader blank handle 44*a* is fastened and conveyor 30 with flexible strip begins to move down, the cocked out pawls 81 will be supported this handle 44*a* to be severed from the flexible strip.

The pivotally reciprocating movement of the conveyor 30 relative to the axis 73 is power operated by means of a pneumatic cylinder 62 and springs 63. As mentioned in the description of the previous U.S. application Ser. No. 07/697,254 (May 8, 1991) the machine is intended to be driven continuously, and therefore most movable parts of the machine move in timed or synchronized relationship which may be obtained by means of any conventional driving and synchronizing mechanisms well known in the art, and therefore not described in detail in this specification.

Attaching the handle to the folded box is accomplished by two clinching mechanisms 40 each of which comprises a pneumatic cylinder 66 and clincher 67 with tooth 68. In the position shown in FIG. 2 (left hand side), the rod of the cylinder 66 is completely extended, and the clincher 67 is located under the flexible strip 20 of blank handles. Upon initial retraction of the cylinder 66 the clincher 67 begins to turn about axis 69 to start bending the legs 43 of the handle 44 about the rest 75. Continued retraction of the cylinder 66 (FIG. 2 right hand side) brings the end 70 of the leg 43 in contact with the workpiece and finally, attaches (by both clinching mechanisms) the handle to the folded box. If the machine is feeded with flexible strip having blank handles type "B" (with bent ends) the clincher 67 bends the legs 43 of the leader handle 44*a* (FIG. 4) and attaches it to the folded box. The teeth 68 of the clinchers 67 in this case only touched the bent ends 24 of the next handle 44*b*. In the other case when the machine is feeded with flexible strip having blank handles type "A" (completely straight) the clinchers 67 are bend the legs and attached leader handle 44*a* to the folded box and in the same cycle bend the ends 24 of the next handle 44*b* by teeth 68 (FIG. 6). So, the machine can use both types of the handles without complicated re-equipments. Only spacers 84 are provided for centring the flexible strip with handles type "B" in the conveyor 30 (on FIG. 6 shown only one spacer).

Figure 2:
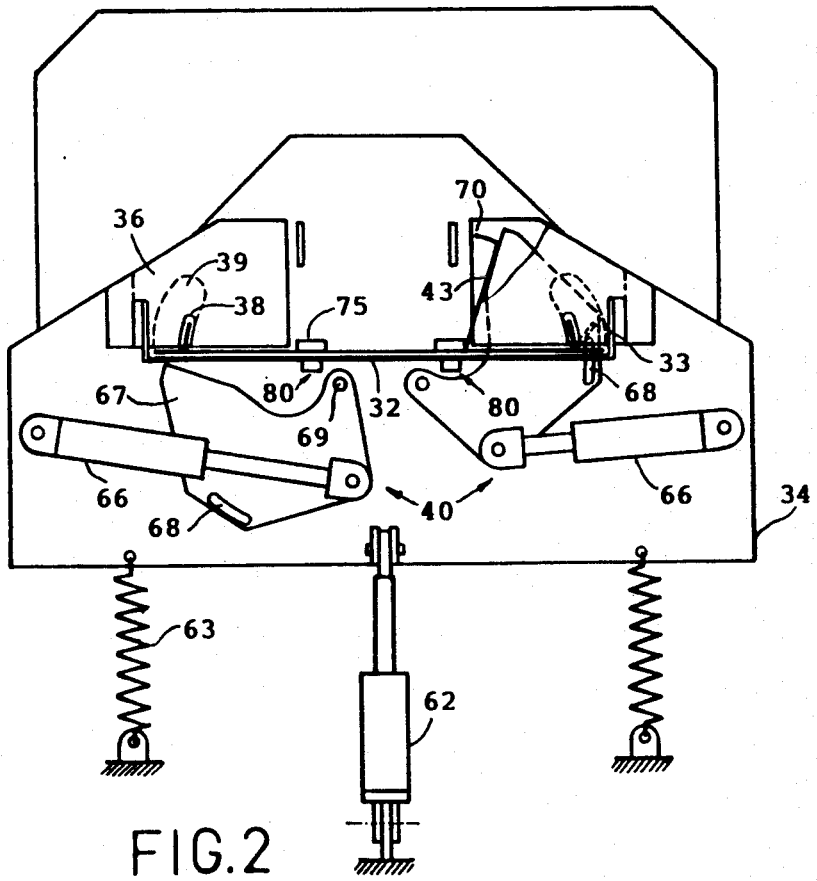
FIG. 2 is an enlarged cross-section view of the conveyor with portions broken away taken along lines 2—2 of FIG. 1.
Figure 3:
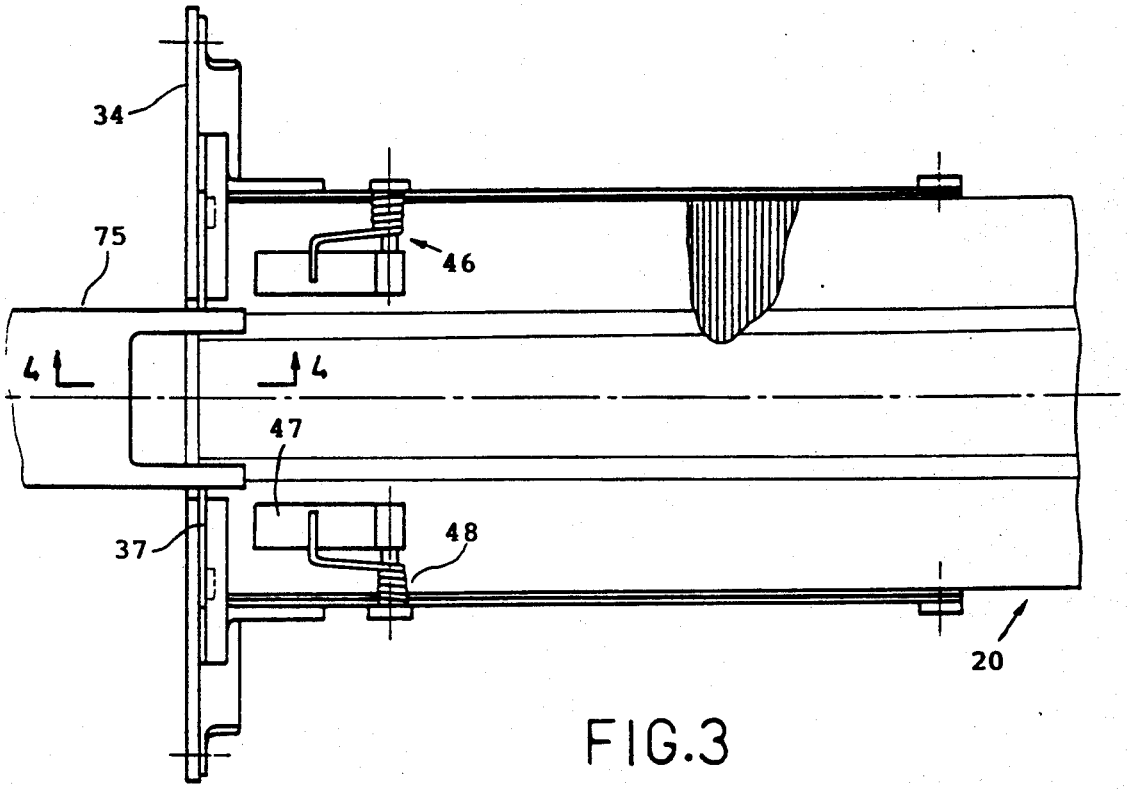
FIG. 3 an enlarged fragmentary plan view of FIG. 1.
Figure 4:
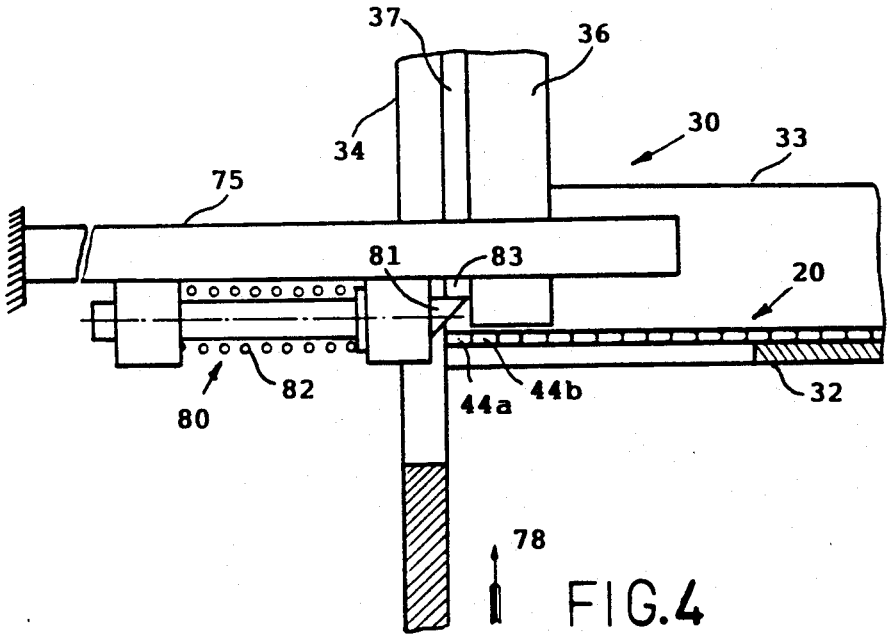
FIG. 4 is an enlarged side elevation view showing the latch mechanisms and forward end of the conveyor taken along lines 4—4 of FIG. 3.
Figure 5:
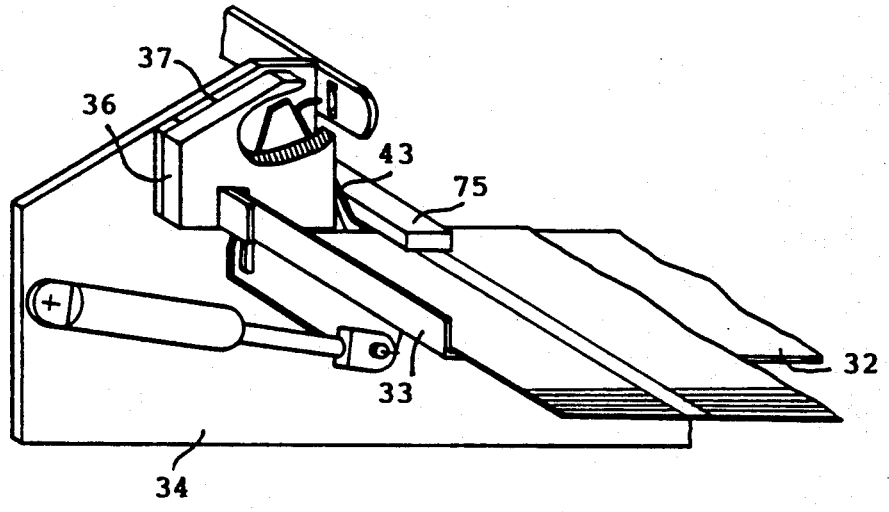
FIG. 5 fragmentary left hand side perspective view of the conveyor.

As shown in FIG. 1, the feed means 50 for feeding the flexible strip 20 of blank handles to the place for attaching them to the folded boxes comprises two solenoids: stationary 51 and movable 52. The stationary solenoid 51 is secured to the bracket 53 of the conveyor 30 and has a core 54 which slides in plane parallel to the conveyor. The core 54 has an extended end 55. Its other end is joined with an extention spring 56 which holds the core in an extention position. To the end 55 of the core 54 is mounted the movable solenoid 52. Its core 57 with a friction surface 58 on the end is directed to the flexible strip 20 and slides in a plane perpendicularly to the conveyor 30. This arrangement of the feed means 50 is shown merely by way of an example. Other means of feeding the flexible strip 20 to the place for attaching handles to the folded boxes may be utilized. For example, by using an independing drive sources, or by using any reciprocation motion from the machine; by using ratchet type mechanism, or friction type, etc.

The operation of feeding the next blank handle of the flexible strip 20 into position for attachment to the folded box is as follows. After movable solenoid 52 is energized and the friction surface 58 of the core 57 come into contact with the flexible strip 20, the stationary solenoid 51 is energized. Its core 54 extended by spring 56 now is retracted to stretch the spring 56 and drive solenoid 52. Together with movable solenoid 52 the flexible strip 20 is driven to the rest of the plate 34, due to friction force applied from solenoid 52 with its friction surface 58. The next step in one full cycle of the feeding machine with handles is de-energizing of the movable solenoid 52 to let its core 57 disconnect from the flexible strip. And the last operation when the stationary solenoid 51 is de-energized its core 54 is extended by the spring 56. Energizing and de-energizing of these solenoids is provided by any conventional swiching means well known in the art and therefore not described in this specification.

I claim:

1. An automatic machine for producing pail boxes from pre-made blanks of paper and pre-made blank handles comprising:

a frame that defines a box blank storage, a box blank feeding means for feeding the box blanks from the storage to position for folding, a folding means for folding said box blanks in form of a box, a conveyor means for conveying the blank handles, a clinching means for attaching said handles to the folded boxes, and a receiver means for receiving made boxes, wherein the improvement comprises:

A. means for accepting a removable spool with a flexible strip of said blank handles joined together by readily severable adhesive tapes, said blank handles being straight or having bent ends, B. said clinching means comprising a pair of clinching mechanisms rigidly attached to the forward end of said conveyor, said clinching mechanisms each including gauged groove and clincher for selecting and pushing through the groove only one leading blank handle per cycle and attaching it to the folded box, said clinching mechanisms including also a pair of hollows, anvils, and teeth for bending the ends of the following blank handle in the same cycle, if said blank handles are straight, and a pair of slots for passing said blank handles with preliminarily bent ends.

C. a feed means for feeding said flexible strip of blank handles to the position for attaching said handles to the folded boxes, said feed means comprising a first solenoid fixed to said conveyor with an extension core slidable in plane parallel to said conveyor, a spring for holding said core of said first solenoid in an extended position, and a second solenoid fixed to a free end of said first solenoid's core, said second solenoid having a core with a friction surface on its end directed to said flexible strip and slidable in plane perpendicularly to said conveyor, said first and second solenoids being energized and de-energized in timed relationship, and D. an anti-retraction means secured to said conveyor, said anti-retraction means including a plurality of pawls and springs for urging the pawls against said flexible strip to prevent retrograde movement of said strip during operation.

2. The automatic machine of claim 1 wherein said feed means includes pawl means for feeding said flexible strip of blank handles to the position for attaching said handles to the folded boxes.

* * * * *